US005951306A

United States Patent [19]

Millhimes

[11] Patent Number: 5,951,306

[45] **Date of Patent: *Sep. 14, 1999**

[54] MODULAR CONNECTOR ASSEMBLY

[75] Inventor: Wayne Leroy Millhimes, Hershey, Pa.

[73] Assignee: The Whitaker Corporation, Wilmington, Del.

[ * ] Notice: This patent issued on a continued prosecution application filed under 37 CFR 1.53(d), and is subject to the twenty year patent term provisions of 35 U.S.C. 154(a)(2).

[21] Appl. No.: 08/823,002

[22] Filed: Mar. 21, 1997

Related U.S. Application Data

[60] Provisional application No. 60/014,746, Mar. 29, 1996.

[51] Int. Cl.[6] ..... H01R 9/09

[52] U.S. Cl. ..... 439/79; 439/717; 439/569

[58] Field of Search ..... 439/79, 564, 80, 439/540.1, 569, 570, 715, 573, 717

[56] References Cited

U.S. PATENT DOCUMENTS

| | | | |
|---|---|---|---|
| 3,474,397 | 10/1969 | Piasecki | 439/717 |
| 4,322,120 | 3/1982 | Rilling | 439/631 |
| 4,425,018 | 1/1984 | Stenz | 439/716 |
| 4,545,632 | 10/1985 | Maier et al. | 439/43 |
| 4,612,602 | 9/1986 | Weyer et al. | 439/79 |
| 4,790,763 | 12/1988 | Weber et al. | 439/65 |
| 4,797,123 | 1/1989 | Weber | 439/717 |
| 4,818,237 | 4/1989 | Weber | 439/693 |
| 4,820,169 | 4/1989 | Weber et al. | 439/65 |
| 5,104,341 | 4/1992 | Gillissen et al. | 439/79 |
| 5,133,679 | 7/1992 | Fusselman et al. | 439/79 |
| 5,326,285 | 7/1994 | Maros | 439/709 |
| 5,330,360 | 7/1994 | Marsh et al. | 439/76 |
| 5,339,222 | 8/1994 | Simmons et al. | 361/818 |
| 5,591,036 | 1/1997 | Doi et al. | 439/79 |

FOREIGN PATENT DOCUMENTS

| | | | |
|---|---|---|---|
| 0360625A2 | 3/1990 | European Pat. Off. | H01R 13/514 |

OTHER PUBLICATIONS

Search Report Under Section 17; Application No.: GB9706387.9; Date of Search Apr. 25, 1997; 1 Page; Date Mailed: Apr. 28, 1997.

*Primary Examiner*—Neil Abrams
*Assistant Examiner*—T. C. Patel
*Attorney, Agent, or Firm*—Katherine A. Nelson; Anton P. Ness

[57] ABSTRACT

A modular connector assembly (10) includes at least first and second modules (12, 54) securable together to form the longer connector. Each module (52) includes a housing (14, 54) having a flange (32,72) extending outwardly from an endwall (24, 64) thereof that are adjacent one another when the modules (12, 54) are placed in an end to end relationship for forming the longer connector. The first flange (32) includes a base (34) having a first opening (36) extending vertically therethrough in communication with the mounting face (18) of first housing (14). The second flange (72) includes a base (74) spaced a selected distance above the mounting face (56) of the second housing 54 and a second opening (76) extending vertically therethrough in communication with the mounting face (58) of the second housing (54). At least portions of the first and second openings (36, 76) are configured for receipt therethrough of a fastener (102) for securing together and co-aligning the first and second modules (12, 54) to form the longer connector assembly 10.

18 Claims, 5 Drawing Sheets

102
52
64
56
79
80
72
78
76
74
75
73
54
58
12
14
38
40
32
37
39
33
36
34
18

MODULAR CONNECTOR ASSEMBLY

RELATED APPLICATION INFORMATION

This is a continuing application of U.S. Pat. application Ser. No. 08/823,002 filed Mar. 21, 1997.

This application claims the benefit of U.S. provisional application No. 60/014,746 filed Mar. 29, 1996.

FIELD OF THE INVENTION

The present invention is directed to electrical connectors and more particularly to modular connectors that can be joined together to form a longer length connector.

BACKGROUND OF THE INVENTION

Today's electronic technology often requires the use of high density connectors of relatively long lengths to handle the number of circuits required for electronic equipment. Long length connectors are typically more difficult to mold than are shorter ones. It is desirable, therefore, to provide a way to mold shorter modular units of connectors that can be secured together to form a connector of the desired longer length. Additionally, with the longer connectors it is often desirable to have guide pins intermediate the ends thereof for assuring alignment of the mating connectors prior to engagement of the terminals therein. It is also desirable to provide additional hardware for securing the connector to a circuit board intermediate the ends thereof.

U.S. Pat. No. 4,790,763 shows one way of interconnecting modular connectors in which the sides of the housings have slots and latches to secure adjacent modules together. The interlocking structure in the '763 patent, however, requires that the adjacent housings be rotated to engage the interlocking latches and slots. Thus the connector needs to be completely assembled prior to mounting to a circuit board for the like. When working with longer connectors, it is also desirable to have a structure to secure the modules together that allows the connector modules to be mounted to the circuit board individually, that is, without requiring the units to be completely assembled prior to mounting to the board.

SUMMARY OF THE INVENTION

The present invention is directed to a modular connector assembly including at least a first connector module and a second connector module securable together to form a longer length connector. The first connector module includes a housing having a first flange extending outwardly from an endwall thereof. The second connector module includes a housing having a second flange extending outwardly from an endwall thereof. The first and second flanges are on the endwalls of the respective housings that are adjacent one another when the first and second connector modules are placed in an end to end relationship for forming the longer connector. The first flange includes a base proximate the mounting face of the first housing having a first opening extending vertically therethrough in communication with the mounting face thereof. The second flange includes a base spaced a selected distance above the mounting face of the second housing. The flange base has a second opening extending vertically therethrough in communication with the mounting face of the second housing. At least portions of the first and second openings are configured for receipt therethrough of a fastener for securing together and co-aligning the first and second connector modules when the first and second modules are placed in an end to end relationship with respective mounting faces thereof being generally coplanar.

It is an object of the present invention to provide a method of interlocking modular units that allows sequential mounting of the modules to a circuit board. The modular units furthermore make it easier and more cost effective to replace a single unit rather than a longer connector, if repair is needed.

It is a further object of the invention to provide an interlocking means that will also permit the use of additional guide pins for the long connector assembly if desired.

The present invention has the further object of providing a locking structure that is molded integrally with the housing.

Embodiments of the invention will now be described by way of example with reference to the accompanying drawings.

DETAILED DESCRIPTION OF THE DRAWINGS

Figure 3:
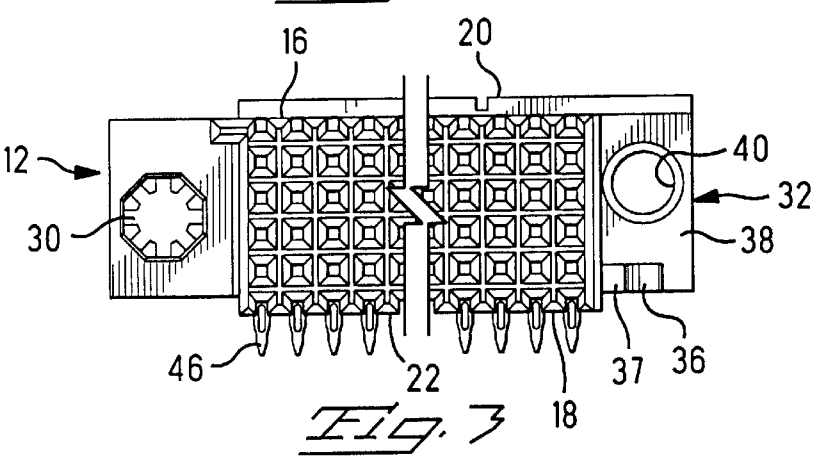
FIG. 3 is a front plan view of the module of FIG. 2.
Figure 6:
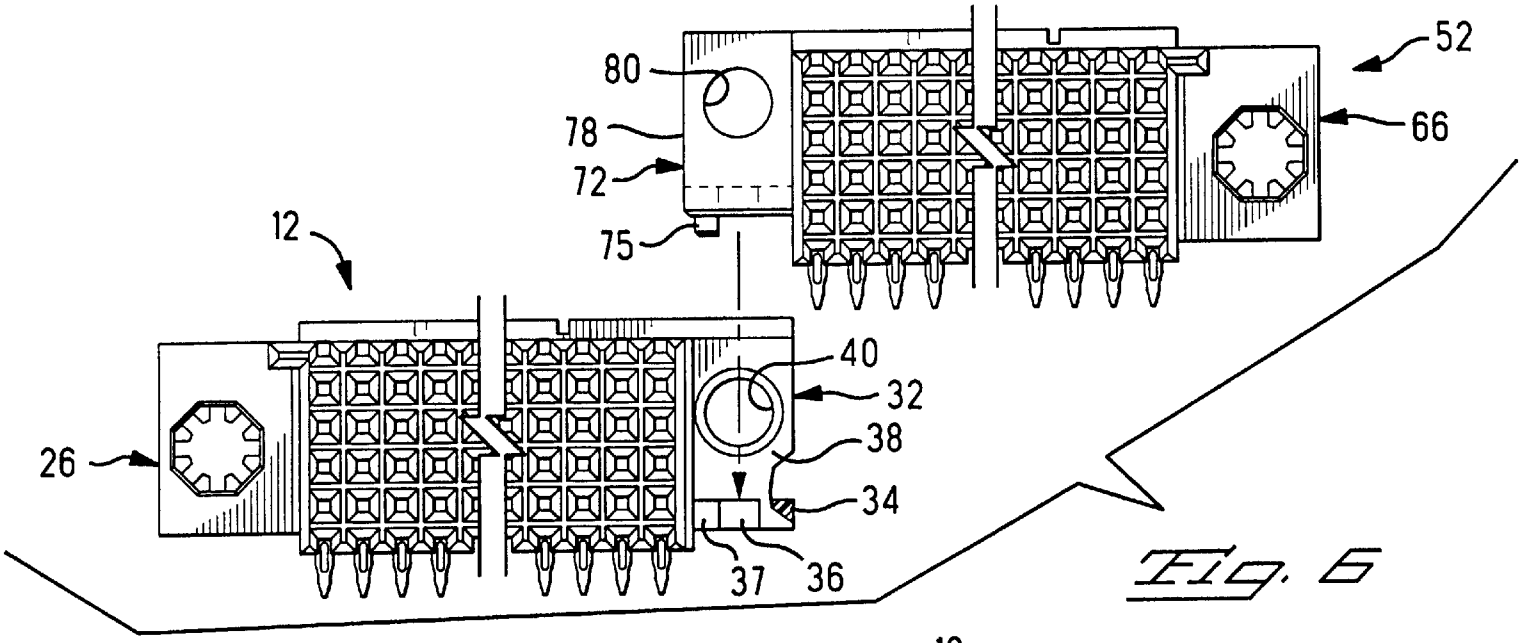
FIG. 6 is front plan view of the modules of FIGS. 3 and 5 exploded from one another.
Figure 7:
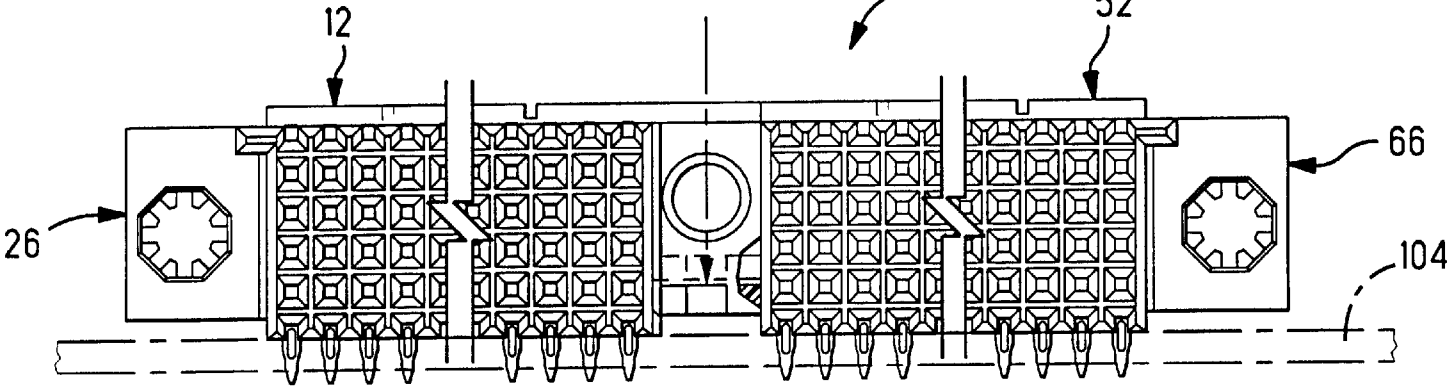
FIG. 7 is a front plan view of the assembled modules of FIG. 6.

Referring now to FIGS. 1 through 8, connector 10, as shown in FIG. 7, is formed by securing respective flanges 32, 72 of first and second connector modules 12, 52 together. Connector module 12 as shown in FIGS. 1, 2, 3, and 6 through 8 includes a housing 14 having a mating face 16, a rear face 17 and a mounting face 18. In the embodiment shown, the mating face 16 and rear face 17 are defined on opposed side walls of the housing. Housing 14 includes a top wall 20 a bottom wall 22 and opposed end walls 24. The mounting flange 26 extends outwardly from one of the end walls 24 and includes a mounting aperture 28 and a keying aperture 30 for receiving a keying member (not shown), as known in the art. A flange 32 adapted to secured to a cooperating flange of another module extends outwardly from the other end wall 24 of module 12. Flange 32 includes a base 34 and a vertical wall 38. Base 34 includes an aperture 36 extending therethrough for receiving a fastener 102, such as a rivet or screw to secure the modules together and mount the connector to the board as more fully explained below. The vertical wall 38 includes an aperture 40 adapted to receive a guide pin (not shown). Module 12 further includes a plurality of terminals 44 disposed in terminal receiving passageways 42. Terminals 44 include board mounting portions 46 as shown in FIG. 3.

Referring now to FIGS. 4 through 8, the second module 52 includes a housing 54 having a mating face 56, mounting face 58 and rear face 57. Housing 54 has a top wall 60 a bottom wall 62 and opposed end walls 64. A mounting flange extends outwardly from one of the end walls 64, as shown in these Figures to the right of the connector housing end wall 64. The mounting flange 66 includes a aperture 68 for receiving mounting hardware therein (not shown) and an aperture 70 for receiving a keying mechanism (not shown) as known in the art. Extending outwardly toward the first module 12 from the opposite end wall 64 is a flange 72 including a base 74 having a slot 76 therein adapted to receive fastener 102 when the first and second modules 12, 52 are assembled to form connector 10 as shown in FIGS. 6 and 7. Module 52 includes a plurality of electrical terminals 84 disposed in terminal receiving passageway 83 and include board mounting portions 86 shown as compliant pins extending from the mounting face 58 of the housing.

Figure 8:
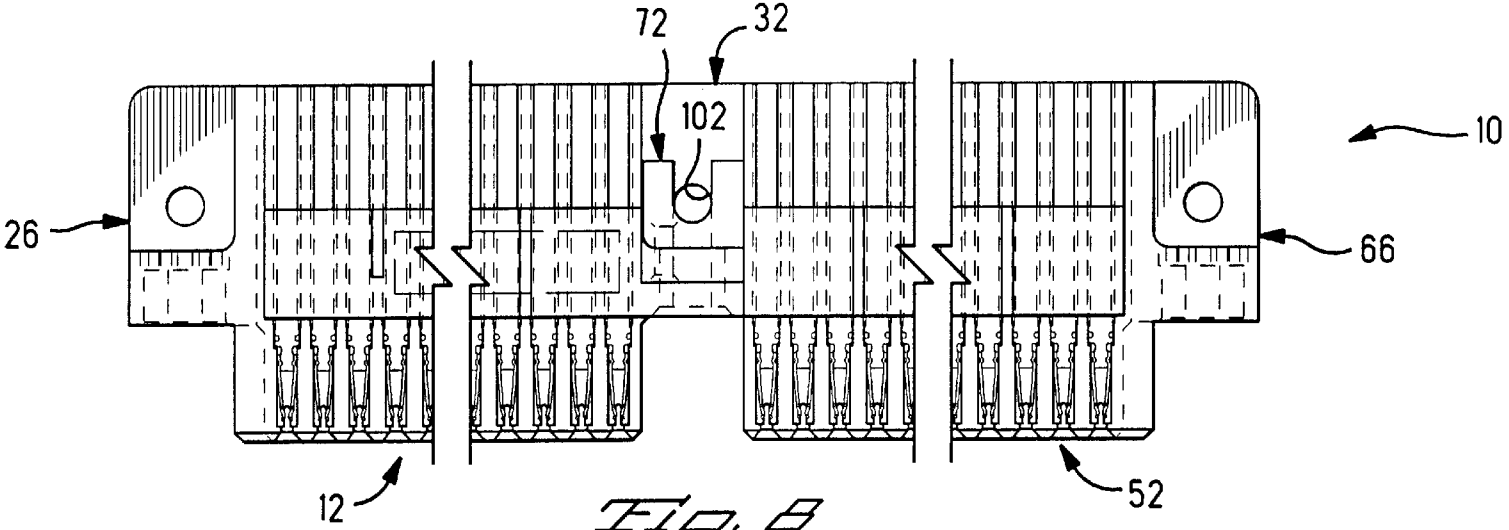
FIG. 8 is a top plan view of the connector assembly of FIG. 7.

As can be appreciated from FIG. 6, the first module 12 can be mounted to a circuit board prior to assembly of the second module 52. This is partially advantageous when using terminals having compliant board mounting portions that are disposed in respective circuit holes by means of applying force to the top wall 20 thereof. The ability to mount the modules individually requires a tool only the size of the individual modules, rather than a tool that can mount the entire connector at one time. FIGS. 7 and 8 show the connector assembly from the mating face and from the top respectively. FIG. 7 shows connector 10 mounted to a circuit board 104 shown in phantom.

Figure 1:
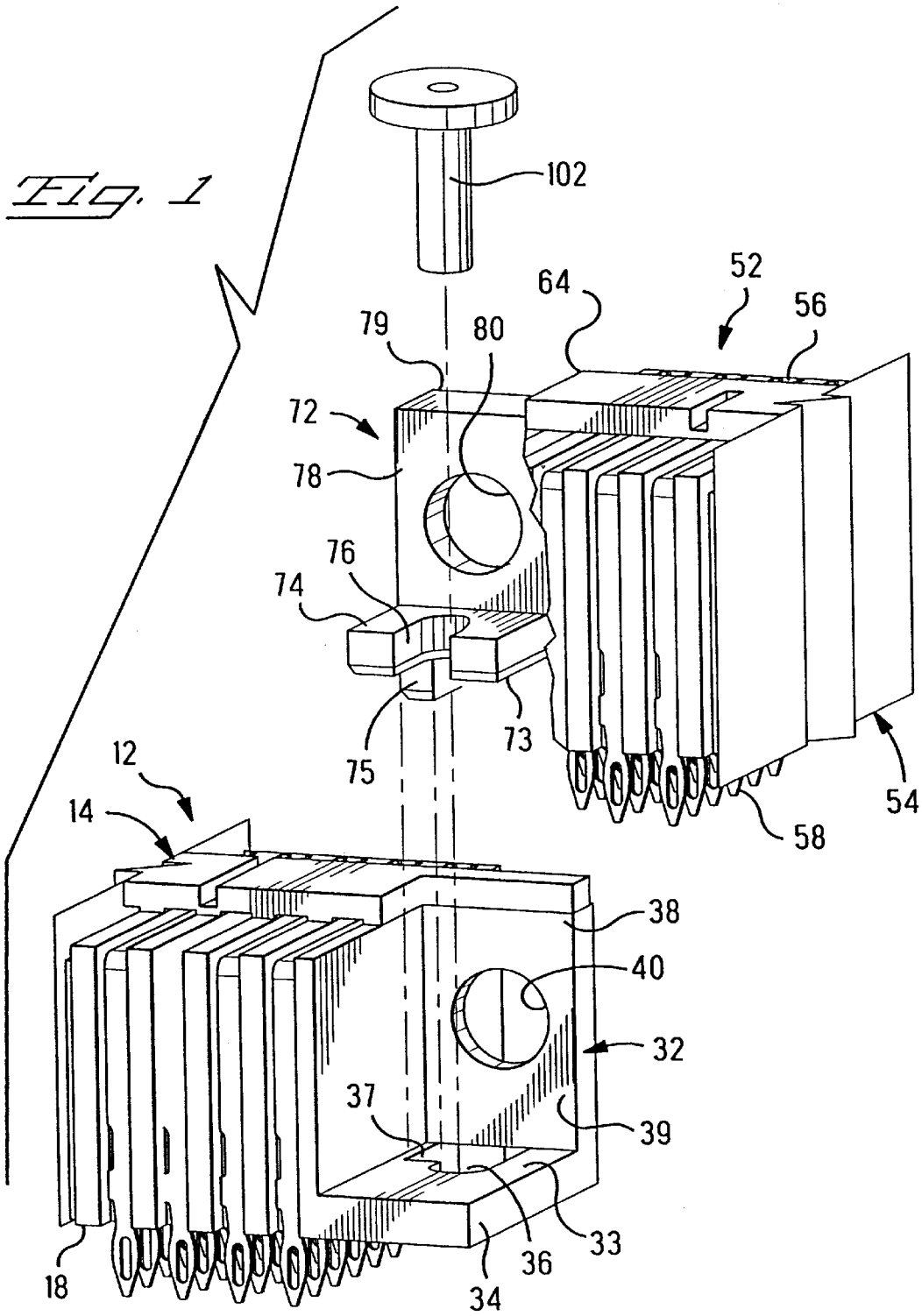
FIG. 1 is a fragmentary isometric view of two connector modules having flanges that are securable together in accordance with the invention with the modules exploded from one another.
Figure 4:
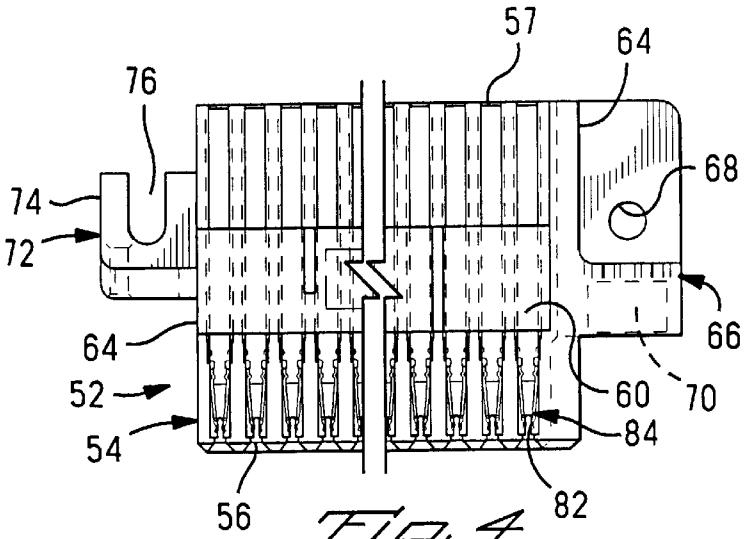
FIG. 4 is a top plan view of a second module made in accordance with the invention.
Figure 5:
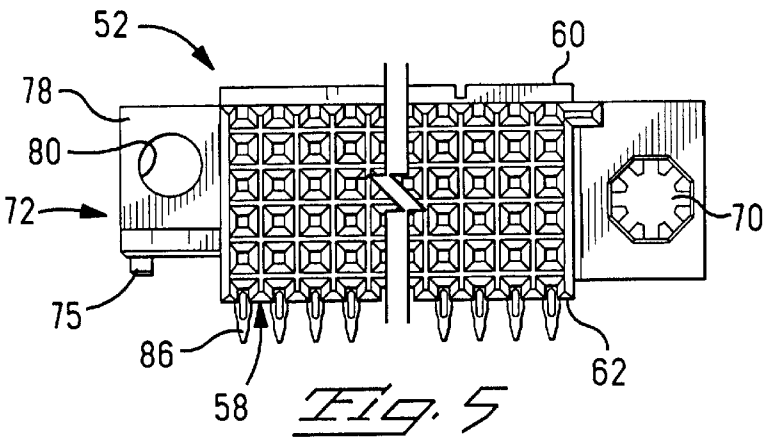
FIG. 5 is a front plan view of the module of FIG. 4.
Figure 2:
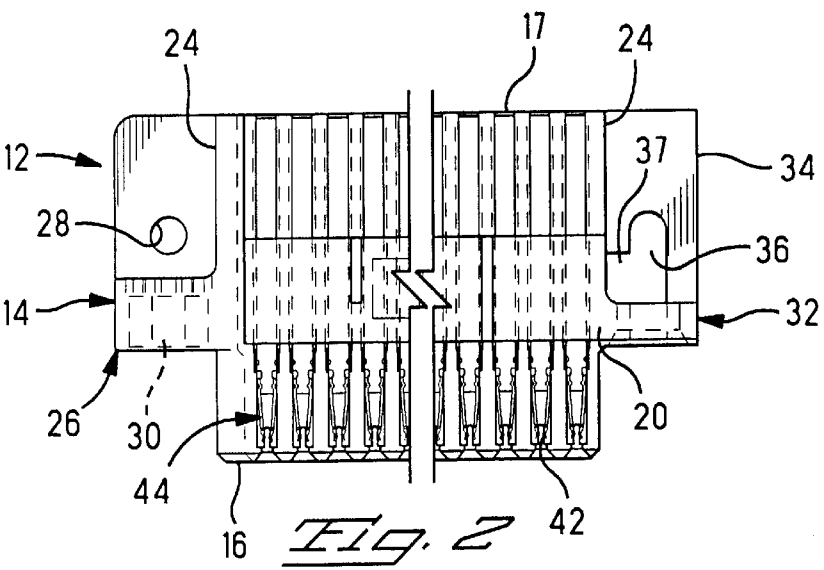
FIG. 2 is a top plan view of a first module made in an accordance with the invention.

The structure of flanges 32 and 72 and the cooperating features thereof are best understood by referring to FIG. 1, which illustrates fragmentary portions of the two connector modules 12 and 52.

Flange 32 of module 12 has a base 34 that extends outwardly along the mounting face 18. Base 34 includes aperture 36 extending vertically therethrough in communication with the mounting face 18. Aperture 36 is configured at 37 to receive a keying tab 75 of flange 72 of module 52 as more fully explained below. In the preferred embodiment flange 32 further includes a vertical wall 38 that is an extension of the front housing wall. Wall 38 includes an aperture 40 extending horizontally therethrough for receipt of a guide pin from a mating connector (not shown).

Flange 72 of module 52 has a base 74 that extends outwardly a selected distance above the mounting face 58, the selected distance being the thickness of base 36 of flange 32. Base 74 includes a slot 76 extending vertically therethrough in communication with the mounting face 58. A keying tab 75 extends downwardly toward the mounting face 58 from the lower surface 73 of base 74 and is configured to be received in aperture portion 37 of flange 32 when the two modules are secured together to form a longer connector. In the preferred embodiment flange 72 further includes vertical wall 78, which is spaced rearwardly from the front wall of module a distance substantially equal to the thickness of vertical wall 38 of flange 32. When the two modules 12, 72 are assembled together, the lower surface 73 of flange base 74 is positioned on upper surface 33 of flange base 34 such that tab 75 is received in aperture portion 37 thus preventing rearward misalignment of the two modules. Concomitantly the outer surface 79 of vertical wall 78 is positioned against inner surface 39 of vertical wall 38, thus preventing forward misalignment of the modules. As shown in FIG. 1, a fastener 102, such as a screw or rivet, may then be inserted through slot 76 and aperture 36 to secure the connectors together. In the preferred embodiment the fastener is also used to secure the longer connector to the circuit board intermediate the ends of the connector. The features of the flanges have been illustrated with right angle connector modules. It is to be understood the same flange and securing method may be used with vertically mounted connector modules as well.

Figure 10:
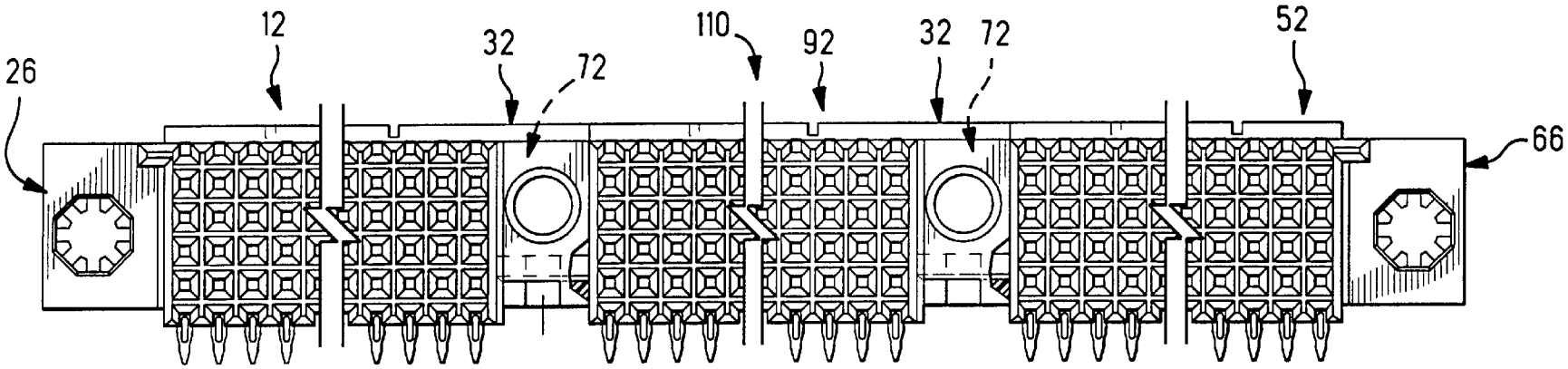
FIG. 10 is a front plan view of the assembled connector of FIG. 9.
Figure 9:
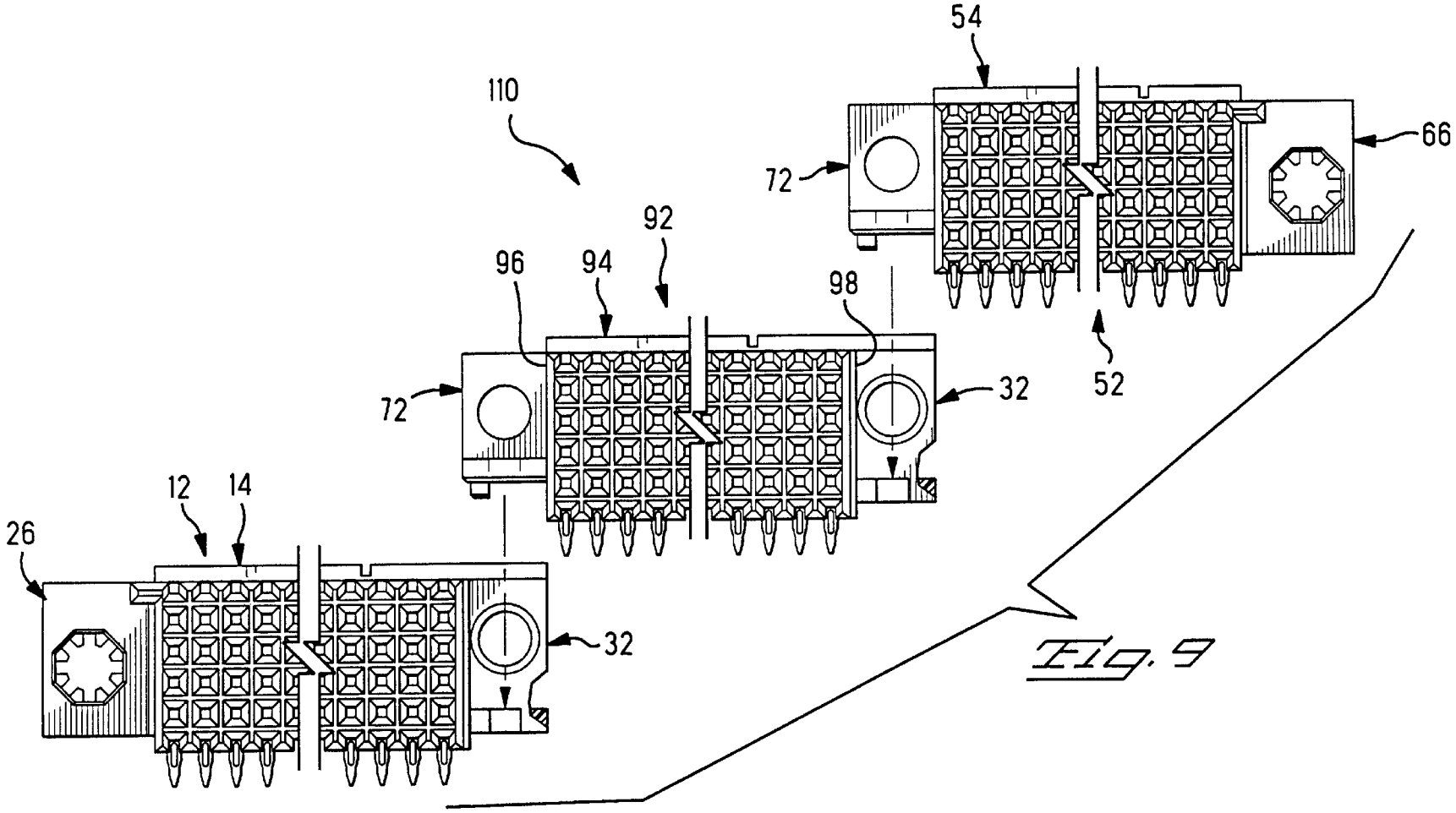
FIG. 9 is a front plan exploded view of the module of FIG. 3 exploded from a third module made in accordance with the invention and further exploded from a module of FIG. 5.

FIGS. 9 and 10 show a further embodiment of the invention in which a first module 12 and a second module 52 are spaced from each other by at least one third module 92. Third module 92 includes a housing 94 having opposed end walls 96, 98. The left end wall 96 includes a flange configured in the same manner as flange 72 of module 52. The right end wall 98 includes a flange configured in the same manner as flange 32 of module 12. As can be appreciated from FIGS. 9 and 10 a plurality of intermediate modules 92 can be placed and secured between first and second modules 12, 52 respectively to provide a connector assembly of a selected length. As previously discussed, when the terminals of the connector modules include compliant board mounting portions these individual modules may be inserted on the boards sequentially instead of as an assembled long connector. If the long connector includes terminals having solder tails, it is generally more cost effective to assemble the longer connector first and solder the entire connector at one time.

The modular connector assembly of the present invention provides an assembly that permits individual sections to be removed and replaced if necessary, which is more cost effective than having to replace a much longer connector. The smaller sections are easier to handle and assemble to a circuit board. The modules are configured to be interlocked together to prevent relative movement rearward and forward and to provide additional locations at which to secure the connector to the circuit board, thus reducing stress to the compliant pin or soldered connections when the connector assembly is mated or unmated to a complementary connector.

It is thought that the securable connector modules of the present invention and many of the attendant advantages will be understood from the foregoing description. It is apparent that various changes may be made in the form, construction, and arrangement of parts thereof without departing from the spirit or scope of the invention, or sacrificing all of its material advantages.

I claim:

1. A modular connector assembly comprising:

at least a first connector module and a second connector module securable together to form a long length connector;

each of said first and second modules including a housing having a mounting face, an opposed top face, opposed side walls, and opposed end walls and an array of terminals disposed in terminal-receiving passageways;

said housing of said first module includes a first flange extending outwardly from one of said end walls, said first flange having a base proximate said mounting face of said housing and having a first opening extending vertically therethrough in communication with the mounting face of the first housing; and said housing of said second module includes a second flange extending outwardly from one of said end walls, said one of said end walls of said first module housing being adjacent said one of said end walls of said second module housing when said first and second modules are placed in an end to end relationship, said second flange having a base spaced a selected distance above said mounting face of said housing and having a second opening extending vertically therethrough in communication with the mounting face of the second housing; and said second flange shaped and positioned to extend atop a top surface of said first flange when said mounting face of said second module is coplanar with said mounting face of said first module to permit mounting of said second connector module onto a circuit board after said first connector module is at least positioned on said circuit board;

at least portions of the first and second openings are vertically co-alignable for receipt therethrough of a fastener for securing together and co-aligning the first and second connector modules when said first and second modules are placed in an end to end relationship with respective mounting faces thereof being generally coplanar, and said second module includes a key protrusion depending from a bottom surface of said second flange adjacent to said second opening, and said first opening further includes a portion thereof configured to receive said key protrusion thereby aligning said first and second modules in a horizontal direction and assuring proper assembly of said modules.

2. The modular connector assembly of claim 1 wherein at least said first opening is open in a first direction to a side face of said first flange that is associated with one of said sides of said first module.

3. The modular connector assembly of claim 2 wherein at least said second opening is open in a second direction to a side face of said second flange that is associated with one of said sides of said second module.

4. The modular connector assembly of claim 1 further including at least one intermediate module, said intermediate module having a first flange on one end and a second flange on the other end thereof, said second flange being adapted to be secured to a first flange of an adjacent module and said first flange adapted to be secured to said second flange of an adjacent module.

whereby the first and second flanges provide spaces between the arrays of terminals of adjacent ones of said modules for optional fastening of other components.

5. The modular connector assembly of claim 1 wherein said first flange has a side wall extending vertically upwardly therefrom parallel to said mating face and spaced inwardly therefrom and having a first hole therethrough, and said second flange has a side wall extending vertically upwardly therefrom parallel to said mating face and having a second hole therethrough, said first and second holes being aligned horizontally for receipt therethrough of a guide post when said second connector module is in position with respect to said first connector module with said side wall of said second flange forwardly of said side wall of said first flange.

6. A modular connector assembly comprising:

at least a first connector module and a second connector module securable together to form a long length connector;

each of said first and second modules including a housing having a mounting face, an opposed top face, opposed side walls, and opposed end walls and an array of terminals disposed in terminal-receiving passageways;

said housing of said first module includes a first flange extending outwardly from one of said end walls, said first flange having a base proximate said mounting face of said housing, having a first opening extending vertically therethrough in communication with the mounting face of the first housing, and having a side wall extending vertically upwardly therefrom having a first hole horizontally therethrough; and said housing of said second module includes a second flange extending outwardly from one of said end walls, said one of said end walls of said first module housing being adjacent said one of said end walls of said second module housing when said first and second modules are placed in an end to end relationship, said second flange having a base spaced a selected distance above said mounting face of said housing and having a second opening extending vertically therethrough in communication with the mounting face of the second housing, and said second flange having a side wall extending vertically upwardly therefrom having a second hole horizontally therethrough;

at least portions of the first and second openings are vertically co-alignable for receipt therethrough of a fastener for securing together and co-aligning the first and second connector modules when said first and second modules are placed in an end to end relationship with respective mounting faces thereof being generally coplanar; and said first hole and said second hole being aligned horizontally for receipt therethrough of a guide post, whereby the first and second flanges provide spaces between the arrays of terminals of adjacent ones of said modules for optional fastening of other components.

7. The modular connector assembly of claim 6 wherein said first opening further includes a portion thereof defined laterally outwardly from a remainder thereof configured to received a key protrusion extending from the second module thereby assuring proper assembly of said modules.

8. The modular connector assembly of claim 6 wherein said second module includes a key protrusion depending from a bottom surface of said second flange adjacent to said second opening, and said first opening further includes a portion thereof configured and positioned to receive said key protrusion thereby aligning said first and second modules in a horizontal direction and assuring proper assembly of said modules.

9. The modular connector assembly of claim 6 wherein said second flange shaped and positioned to extend atop said first flange when said mounting face of said second module is coplanar with said mounting face of said first module to permit mounting of said second connector module onto a circuit board after said first connector module is at least positioned on said circuit board.

10. A modular connector assembly comprising:

at least a first connector module and a second connector module securable together to form a long length connector, each of said first and second modules including a housing having a board-mounting face, an opposed top face, opposed side walls, and opposed end walls, one of said side and top faces defining a mating face;

each of said first and second connector modules including respective arrays of terminals in pluralities of rows having board-connecting sections depending from said board-mounting faces thereof and contact sections exposed along said mating faces thereof;

said housing of said first module includes a first flange extending outwardly from one of said end walls spaced from said terminal array thereof, said first flange having a base proximate said board-mounting face of said housing and having a first opening extending vertically therethrough in communication with the board-mounting face of the first housing; and said housing of said second module includes a second flange extending outwardly from one of said end walls spaced from said terminal array thereof, said one of said end walls of said first module housing being adjacent said one of said end walls of said second module housing when said first and second modules are placed in an end to end relationship, said second flange having a base spaced a selected distance above said board-mounting face of said housing and having a second opening extending vertically therethrough in communication with the board-mounting face of the second housing;

at least portions of the first and second openings are vertically co-alignable for receipt therethrough of a fastener for securing together and co-aligning the first and second connector modules when said first and second modules are placed in an end to end relationship with respective mounting faces thereof being generally coplanar, whereby the first and second flanges provide spaces between the arrays of terminals of adjacent ones of said modules for optional fastening of other components.

11. The modular connector assembly of claim 10 wherein said first opening further includes a portion thereof configured to received a key protrusion extending from the second module thereby assuring proper assembly of said modules.

12. The modular connector assembly of claim 10 wherein said second module includes a key protrusion depending from a bottom surface of said second flange adjacent to said second opening, and said first opening further includes a portion thereof configured to receive said key protrusion thereby aligning said first and second modules in a horizontal direction and assuring proper assembly of said modules.

13. The modular connector assembly of claim 10 wherein said first flange has a side wall extending vertically upwardly therefrom parallel to said mating face and spaced inwardly therefrom and having a first hole horizontally therethrough, and said second flange has a side wall extending vertically upwardly therefrom parallel to said mating face and having a second hole horizontally therethrough, said first and second holes being aligned horizontally for receipt therethrough of a guide post when said second connector module is in position with respect to said first connector module with said side wall of said second flange forwardly of said side wall of said first flange.

14. The modular connector assembly of claim 10 wherein said second flange is shaped and positioned to extend atop said first flange when said mounting face of said second module is coplanar with said mounting face of said first module to permit mounting of said second connector module onto a circuit board after said first connector module is at least positioned on said circuit board.

15. An arrangement of a circuit board and at least two connectors, comprising:

a circuit board, and at least a first connector module and a second connector module, each of said first and second modules including a housing having a board-mounting face, an opposed top face, opposed side walls, and opposed end walls, one of said side and top faces defining a mating face;

each of said first and second connector modules including respective arrays of terminals having board-connecting sections depending from said board-mounting faces thereof and contact sections exposed along said mating faces thereof;

said first connector module being mounted on said circuit board with said board-connecting sections extending through corresponding holes of said circuit board;

said housing of said first module includes a first flange extending outwardly from one of said end walls spaced from said terminal array thereof, said first flange having a base proximate said board-mounting face of said housing and having a first opening extending vertically therethrough in communication with the board-mounting face of the first housing; and said housing of said second module includes a second flange extending outwardly from one of said end walls spaced from said terminal array thereof, said one of said end walls of said first module housing being adjacent said one of said end walls of said second module housing when said first and second modules are placed in an end to end relationship, said second flange having a base spaced a selected distance above said board-mounting face of said housing and having a second opening extending vertically therethrough in communication with the board-mounting face of the second housing;

at least portions of the first and second openings are vertically co-alignable for receipt therethrough of a fastener for securing together and co-aligning the first and second connector modules when said first and second modules are placed in an end to end relationship with respective mounting faces thereof being generally coplanar, whereby said second connector module is mountable separately from said first connector module.

16. The arrangement of claim 15 further including at least one intermediate module, said intermediate module having a first flange on one end and a second flange on the other end thereof, said second flange being adapted to be secured to a first flange of an adjacent module and said first flange adapted to be secured to said second flange of an adjacent module.

17. The modular connector assembly of claim 15 wherein said second module includes a key protrusion depending from a bottom surface of said second flange adjacent to said second opening, and said first opening further includes a portion thereof configured to receive said key protrusion thereby aligning said first and second modules in a horizontal direction and assuring proper assembly of said modules.

18. The modular connector assembly of claim 15 wherein said second flange is shaped and positioned to extend atop said first flange when said mounting face of said second module is coplanar with said mounting face of said first module to permit mounting of said second connector module onto a circuit board after said first connector module is at least positioned on said circuit board.

* * * * *